US010927541B2

(12) United States Patent
Sputo

(10) Patent No.: US 10,927,541 B2
(45) Date of Patent: Feb. 23, 2021

(54) METAL DECK ATTACHMENT CLIP AND METHOD

(71) Applicant: Thomas Sputo, Gainesville, FL (US)

(72) Inventor: Thomas Sputo, Gainesville, FL (US)

( * ) Notice: Subject to any disclaimer, the term of this patent is extended or adjusted under 35 U.S.C. 154(b) by 0 days.

(21) Appl. No.: 16/422,179

(22) Filed: May 24, 2019

(65) Prior Publication Data

US 2020/0370291 A1 Nov. 26, 2020

(51) Int. Cl.

| | |
|---|---|
| ***E04B 1/41*** | (2006.01) |
| ***E04H 9/14*** | (2006.01) |
| ***E04H 9/02*** | (2006.01) |
| *E04B 1/38* | (2006.01) |

(52) U.S. Cl.

CPC ..... *E04B 1/40* (2013.01); *E04H 9/027* (2013.01); *E04H 9/14* (2013.01); *E04B 2001/405* (2013.01)

(58) Field of Classification Search

CPC ..... E04B 1/40; E04B 1/84; E04B 2001/405; E04H 9/14; E04H 9/027

USPC ..... 52/698

See application file for complete search history.

(56) References Cited

U.S. PATENT DOCUMENTS

| | | | | |
|---|---|---|---|---|
| 813,253 | A * | 2/1906 | Sullivan | E04G 11/12 249/44 |
| 1,489,474 | A | 4/1924 | Beckwith | |
| 1,772,694 | A | 8/1930 | White | |
| 2,253,916 | A * | 8/1941 | Richardson | E04D 3/3605 52/489.1 |
| 2,321,221 | A | 6/1943 | Linehan | |
| 2,413,362 | A * | 12/1946 | Maxwell | E04B 1/2608 403/403 |
| 2,426,237 | A * | 8/1947 | Pfeifer, Jr. | E04D 3/3607 52/464 |
| 2,827,676 | A | 3/1958 | Sanford | |
| 3,011,226 | A | 12/1961 | Menge | |
| 3,081,537 | A | 3/1963 | Novy, et al. | |
| 3,110,079 | A | 11/1963 | Wilson et al. | |
| 3,323,269 | A * | 6/1967 | Widdowson | E04D 3/362 52/573.1 |
| D215,727 | S | 10/1969 | Gilb | |
| 3,601,428 | A | 8/1971 | Gilb et al. | |
| 3,651,612 | A | 3/1972 | Schmitt | |

(Continued)

OTHER PUBLICATIONS

American Institute of Steel Construction; excerpts from "Steel Construction", published May 1936, 2 pgs.

(Continued)

*Primary Examiner* — Paolo Agudelo

(74) *Attorney, Agent, or Firm* — Taylor English Duma LLP

(57) ABSTRACT

A one-piece clip includes a stiffener, a first connector plate extending from the stiffener at a first dihedral angle to the stiffener, the first connector plate configured for attachment to a support member extending beneath a corrugated metal deck, and a second connector plate extending from the stiffener at a second dihedral angle to the stiffener, the second connector plate configured for attachment to an underside of the corrugated metal deck. A method of retrofitting a structure to augment its resistance to uplift and seismic forces includes the steps of attaching a first connector plate of a one-piece clip to a support member extending beneath a corrugated metal deck, and attaching a second connector plate of the one-piece clip to an underside of the corrugated metal deck.

3 Claims, 15 Drawing Sheets

(56) References Cited

U.S. PATENT DOCUMENTS

| | | | | |
|---|---|---|---|---|
| 3,972,169 | A * | 8/1976 | Sheppard, Jr. | E04B 1/2608 52/702 |
| 3,998,019 | A | 12/1976 | Reinwall, Jr. | |
| D254,534 | S * | 3/1980 | Glynn | D8/349 |
| 4,367,973 | A | 1/1983 | Gilb et al. | |
| 4,976,085 | A * | 12/1990 | Krueger | E04B 1/2612 403/232.1 |
| D358,755 | S * | 5/1995 | Davis | D8/354 |
| 5,653,079 | A * | 8/1997 | Loeffler | E04B 1/2608 403/396 |
| 6,022,165 | A * | 2/2000 | Lin | E04B 1/2608 403/170 |
| 6,295,781 | B1 * | 10/2001 | Thompson | E04B 1/2608 403/232.1 |
| 6,415,575 | B1 * | 7/2002 | Thompson | E04B 1/2608 52/712 |
| 6,510,666 | B1 * | 1/2003 | Thompson | E04B 1/2608 52/264 |
| 7,065,932 | B2 | 6/2006 | Roesset et al. | |
| D557,113 | S * | 12/2007 | Anders, III | D8/354 |
| 7,503,148 | B2 * | 3/2009 | Lin | E04B 1/2608 248/300 |
| D618,085 | S | 6/2010 | Lin et al. | |
| 8,176,689 | B1 | 5/2012 | Thompson | |
| 8,225,575 | B2 * | 7/2012 | Gadd | E04B 1/2612 52/289 |
| 2002/0112439 | A1 * | 8/2002 | Rosas | E04B 1/2608 52/712 |
| 2008/0244993 | A1 | 10/2008 | Crumley | |
| 2018/0044910 | A1 * | 2/2018 | Lastowski | E04B 1/84 |
| 2019/0081590 | A1 * | 3/2019 | Schaefer | F24S 10/00 |

OTHER PUBLICATIONS

Cleveland Steel; Brochure for Hangers and Anchors, publicly available prior to May 24, 2019, 7 pgs.

Ketchum; Article entitled: "The Design of Steel Mill Buildings", published 1921, at p. 450, 2 pgs.

Mitek; USP® Product Catalog, Copyright 2018, 292 pgs. (See pp. 91, 98-103, 107-08, 117, 120, 234-37, and 264).

Simpson Strong-Tie; Catalog for Wood Construction Connectors, published Jan. 1, 2019, 340 pgs. (See pp. 270-73.).

Steel Deck Institute; Article entitled: "Roof Deck Design: First Edition", published Nov. 2012, 24 pgs.

Simpson Strong-Tie , Simpson Strong-Tie; Catalog for "Connectors for Cold-Formed Steel Construction", published Jun. 1, 2017, 308 pgs. (See pp. 262-63.).

* cited by examiner

METAL DECK ATTACHMENT CLIP AND METHOD

TECHNICAL FIELD

This disclosure relates to structural hardware for buildings. More specifically, this disclosure relates to hardware that can be employed as a retrofit installation on a building to improve its ability to withstand uplift and seismic forces.

BACKGROUND

Hurricanes and earthquakes are known to wreak extensive structural damage upon, if not completely destroy, buildings. Instances of these natural phenomena have resulted in changes to various building codes. For example, regarding hurricanes, changes to building codes have increased the required wind uplift pressures that roofs and connected components must resist. Oftentimes, existing buildings are required to be brought into compliance with these changed codes, requiring supplementing (retrofitting) the existing connections of roofing to the supporting framing. Buildings such as factories, schools, offices, and warehouses, which include metal decks for flooring or roofing, the decks supported upon beams or other support members, are included among existing structures that must be retrofitted for code compliance purposes.

A metal deck is typically constructed of abutting or joined sheets of corrugated steel, though the sheets can also be made from aluminum or stainless steel, or other metals. The supporting framing members are most commonly I-shaped steel beams, steel channels, or open web steel joists (often referred to as bar joists), or steel trusses. However, other metal or wood framing can be used to support the metal deck. For roofing applications, materials such as rubber, asphalt (or other membrane materials), and insulation cover the metal deck to make the roof water-tight and weather-resistant. In flooring applications, metal decks can provide support for concrete or other flooring materials.

A metal deck is normally attached from the upper side, using either welds, screws, or power actuated fasteners (similar to nails) to secure the metal deck to the top surface of the support framing. The type, number, and pattern of the welds or mechanical fasteners (screws or power actuated fasteners) is controlled by several strength and stiffness criteria. One criterion is the uplift resistance of the connection of the metal deck to the support framing.

Bringing buildings with metal decks into compliance with changed building codes requires supplementing (retrofitting) the existing connections of the metal deck to the supporting framing. This typically requires removing any overlaid materials; in the case of a roof metal deck, such materials include but are not limited to the insulation, nailbase, any poured in place roofing materials, the roofing membrane, and installing additional welds, screws, or power actuated fasteners from the top side. Such removal entails added time and expense associated with the structural strength augmentation.

Certain hardware, known in the industry as "hurricane clips," can augment wooden-framed buildings in a retrofit installation. For example, U.S. Pat. No. 8,176,689 to Thompson discloses a clip that connects a rafter to the top of wall wood plates, the clip being attached to sides of both the wood members being interconnected. However, there is no teaching as to how the disclosed clip could be used to attach corrugated metal roofing, let alone an underside of such roofing, or how such a clip could be configured for attachment to a support member having a flange, such as an I-beam or channel member. Furthermore, corrugated metal roofing frequently exhibits depths between its crest and trough sections that are shallower than the thicknesses of the wood beams being interconnected with conventional clips, rendering such clips ill-suited for structures having metal roof decks.

Certain other clips are designed to attach metal roof decks to support members, examples of which may be found in U.S. Pat. Nos. 3,323,269 and 3,998,019 to Widdowson and Reinwall, Jr., respectively. Such clips are positioned beneath the roof deck and are secured at one end to a joint between roofing sheets and at an opposed end to a support member, without the use of drilled fasteners extending through the deck. However, such clips are not disclosed to be installable as retrofits. Furthermore, the fasteners that secure the clips to the support members are loaded in tension, i.e., parallel to the direction of uplift forces that may act upon the deck. Further, they are inserted into the upper side of the support member such that when a fastener is installed, the head of the fastener defines its upper end. During application of uplift forces, such a loading makes the fasteners more vulnerable to failure (i.e., separation of the items being joined) than fasteners located in shear, i.e., perpendicular or substantially perpendicular to the direction of the uplift force, because the "pull-out" resistance is less than the force required to shear a fastener into two pieces. Although Reinwall, Jr. discloses use of a spring clip to distribute clamping load exerted by the fastener and thus apparently to enhance pull-out resistance of the fastener, there is no disclosure indicating that even such a construction would be stronger than one featuring a fastener loaded in shear rather than tension, and there is no disclosure of any shear-loaded fasteners.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In an aspect of the present disclosure, a one-piece clip may comprise a stiffener, a first connector plate extending from the stiffener at a first dihedral angle to the stiffener, the first connector plate configured for attachment to a support member extending beneath a corrugated metal deck, and a second connector plate extending from the stiffener at a second dihedral angle to the stiffener, the second connector plate configured for attachment to an underside of the corrugated metal deck.

In another aspect of the present disclosure, a method of retrofitting a structure to augment its resistance to uplift and seismic forces may comprise the steps of attaching a first connector plate of a one-piece clip to a support member extending beneath a corrugated metal deck, and attaching a second connector plate of the one-piece clip to an underside of the corrugated metal deck.

Various implementations described in the present disclosure can comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations can be realized and obtained by means of the systems, methods, features particularly pointed out in the appended claims. These and other features will become more fully apparent from the following description and appended claims, or can be learned by the practice of such exemplary implementations as set forth hereinafter.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1A:
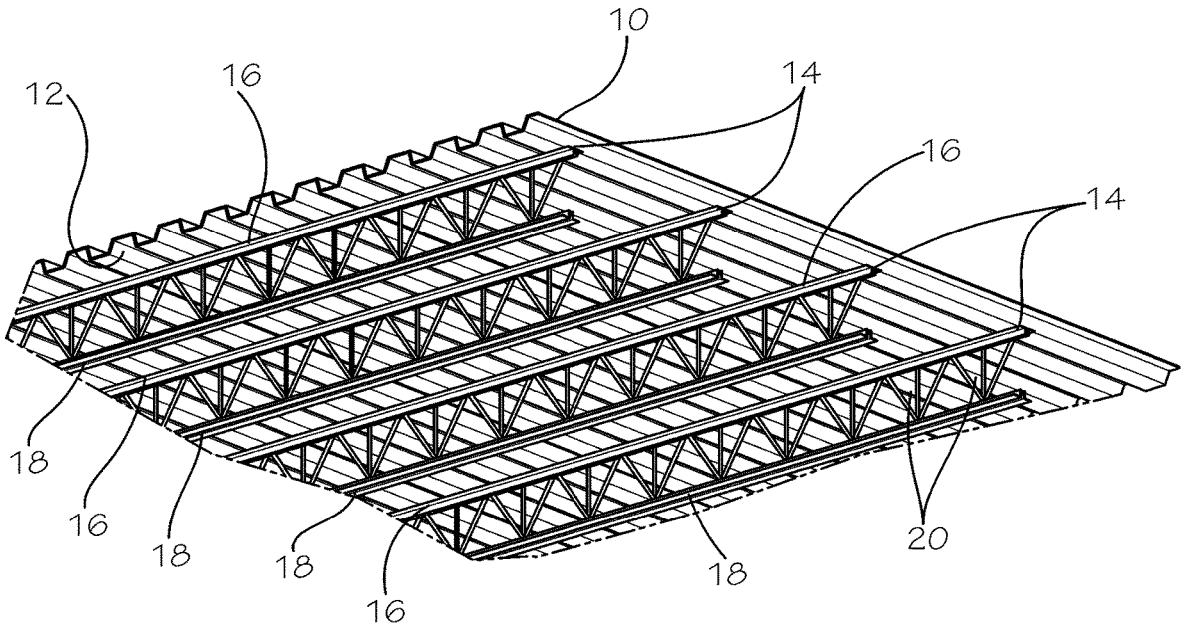
FIG. 1A is a perspective view of an underside of a corrugated metal deck installed as roofing atop its support structure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the present disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list.

To simplify the description of various elements disclosed herein, the conventions of "top," "bottom," "side," "upper," "lower," "horizontal," and/or "vertical" may be referenced. Unless stated otherwise, "top" describes that side of the system or component that is facing upward and "bottom" is that side of the system or component that is opposite or distal the top of the system or component and is facing downward. Unless stated otherwise, "side" describes that an end or direction of the system or component facing in horizontal direction. "Horizontal" or "horizontal orientation" describes that which is in a plane aligned with the horizon. "Vertical" or "vertical orientation" describes that which is in a plane that is angled at 90 degrees to the horizontal.

Disclosed is a metal deck attachment clip that is configured to be retrofitted upon an existing structure for the purpose of augmenting its resistance to uplift and seismic forces, and that overcomes the aforementioned disadvantages associated with conventional methods for providing such augmented resistance. The clip is configured for attachment to the underside of a corrugated metal deck, thereby eliminating any need to remove any overlaid covering materials from the deck, as would be required for attaching augmenting hardware to the top of the deck. Furthermore, in some implementations employing fasteners, at least one fastener attaching the clip to the underside of the deck is loaded substantially in shear, and a fastener that attaches the clip to a support member is loaded upside down, with the installed head oriented downwardly and contacting a flange of the support member to provide augmented pull-out resistance. Additionally, the disclosed clip is universal in that the same clip can be used with varying deck depths and support member dimensions of various sizes. Some implementations can provide an even greater degree of universality by allowing an installer, at an installation site, to bend one portion of the clip with respect to another portion in order to conform the angle between those portions to an angle of inclination of a corrugated metal deck web. These and other benefits are attendant to the metal deck attachment clip disclosed herein.

FIGS. 1A-2B enhance an understanding of the environments into which the disclosed metal deck attachment clip is intended to be used.

Figure 1B:
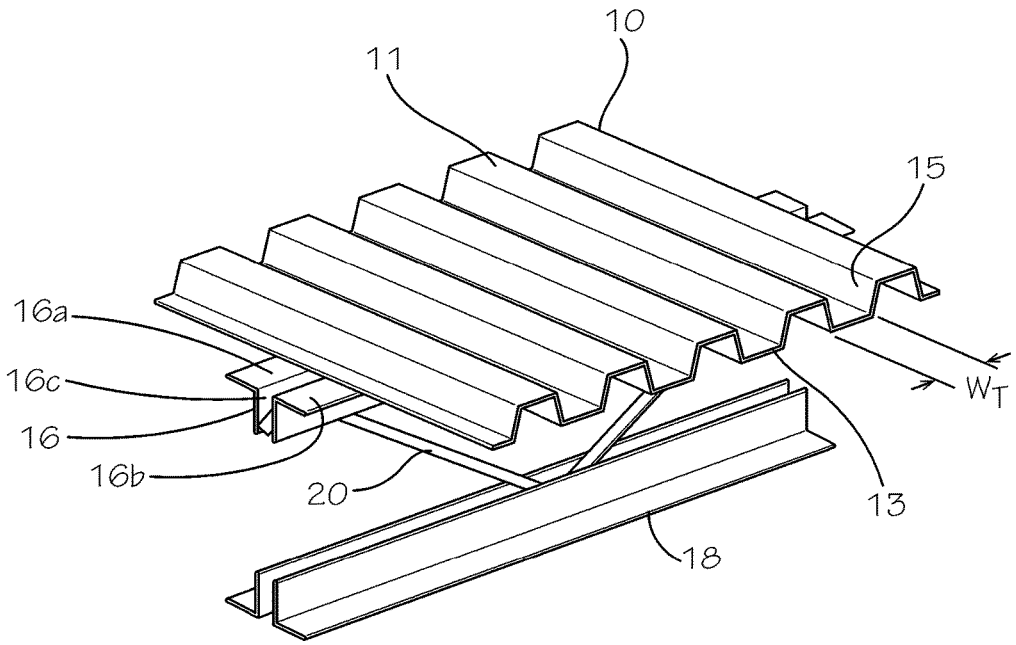
FIG. 1B is a top perspective view isolating a portion of a corrugated metal deck installed as roofing atop its support structure.

FIGS. 1A and 1B illustrate a corrugated metal deck 10 having an underside (bottom side) 12, the corrugated metal deck 10 shown installed as roofing atop its support structure, which can comprise a plurality of support trusses 14 (also known as open web steel joists), each support truss 14 comprising an upper chord 16, a lower chord 18, and a plurality of struts 20 connecting the upper chord 16 and lower chord 18. The corrugated metal deck 10 is defined by a series of crest portions 11, a series of trough portions 13, and a series of web portions 15 connecting the crest portions 11 to the trough portions 13. Each upper chord 16 can include upper flanges 16*a*, 16*b* as well as web sections exemplified at 16*c*. The corrugated metal deck 10 is conventionally attached to its support structure by fastening trough portions 13 to either or both of the upper flanges 16*a*,16*b*. Novel and different means for attaching the corrugated metal deck 10 to its support structure are disclosed herein. The particular shape of the corrugated metal deck 10 shown in FIGS. 1A and 1B is exemplary, and may assume other configurations in terms of relative dimensions of the crest portions 11, trough portions 13, and web portions 15. For example, the configuration shown in FIGS. 1A and 1B is indicative of a "wide rib deck" (also called a "WR deck" or a "Type B deck"), characterized by a greater width $W_T$ of trough portion 13 than other types. Types of decking with narrower trough portion widths $W_T$ include an "intermediate web deck" and "narrow rib deck." Types of decking can also vary by the depth of the web portion 15 relative to width $W_T$ and widths of the crest portions 11.

Figure 2A:
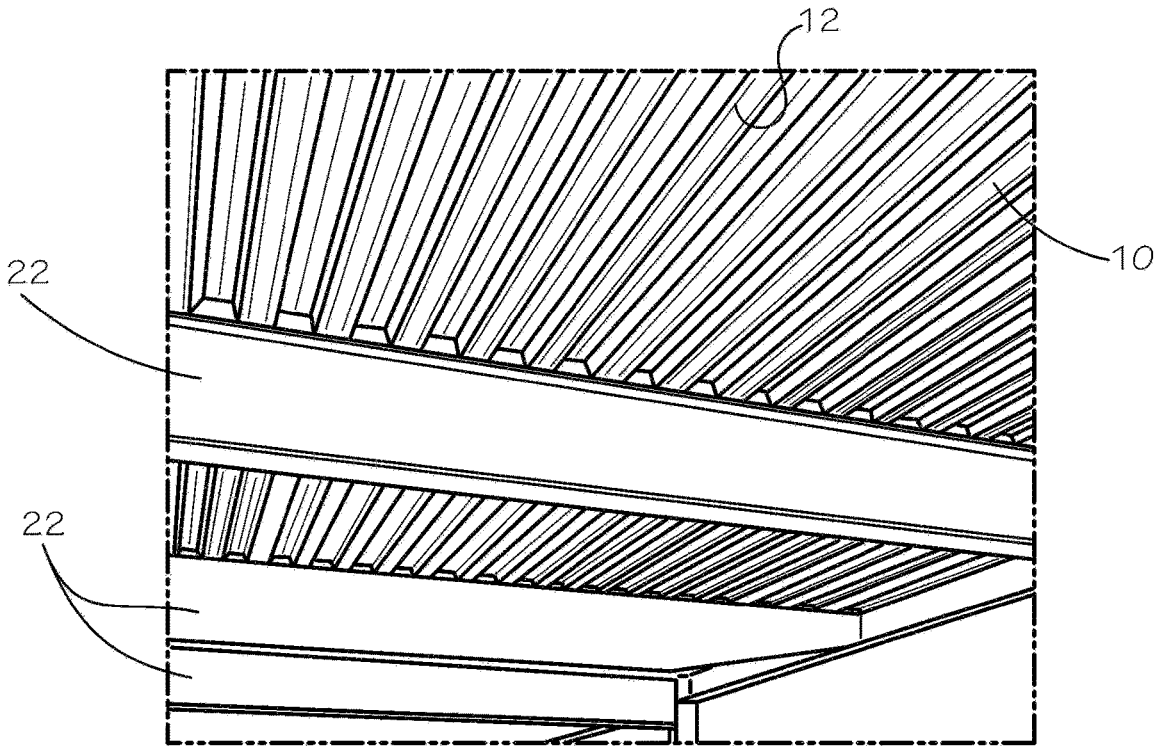
FIG. 2A is a perspective view of a corrugated metal deck installed as flooring atop its support structure.
Figure 2B:
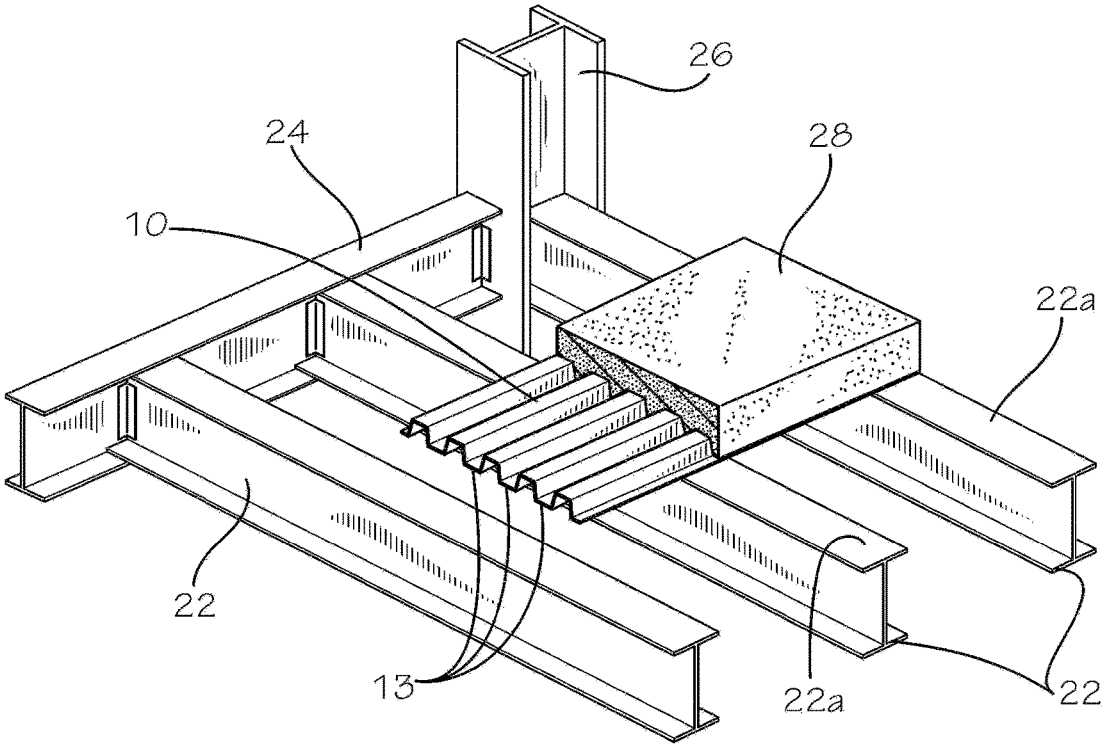
FIG. 2B is a perspective view isolating a portion of a corrugated metal deck installed as flooring atop its support structure, with a portion of a concrete slab added over the metal deck.

FIGS. 2A and 2B are perspective views of the corrugated metal deck 10 and its underside 12 (FIG. 2A), which show the corrugated metal deck 10 installed as flooring atop its support structure, here comprising a plurality of I-beams 22 connected to building frame members 24,26. Each I-beam 22 includes an upper flange 22*a*. Each trough portion 13 of the corrugated metal deck 10 is conventionally attached to several upper flanges 22*a* of respective I-beams 22, thereby securing the corrugated metal deck 10 to its support structure. A next step in the formation of flooring comprises pouring concrete, partially represented by slab portion 28, atop the corrugated metal deck 10.

Figure 3A:
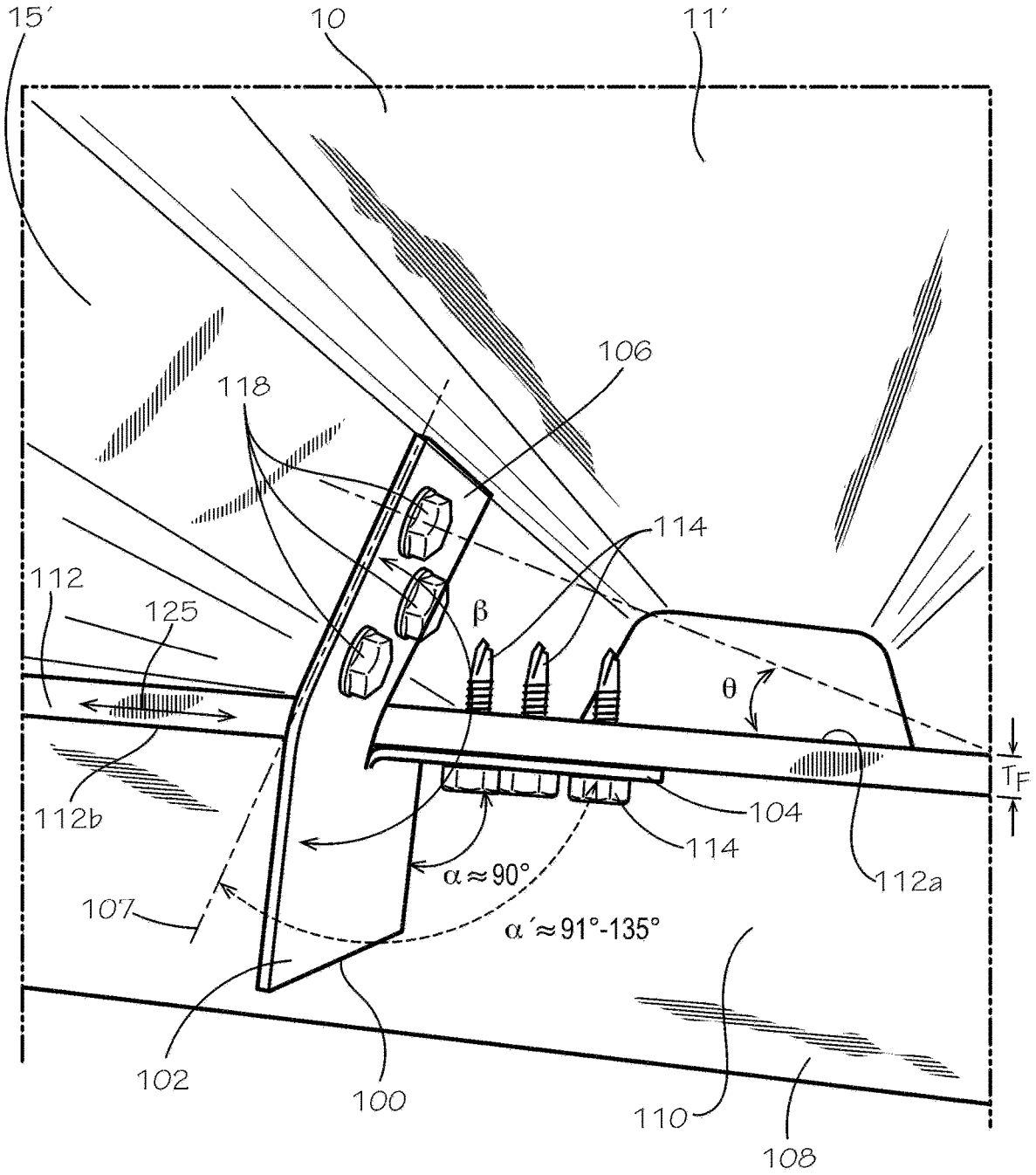
FIG. 3A is a side perspective view illustrating an installed metal deck attachment clip constructed according to an aspect of the present disclosure, and illustrating angular relationships among clip and support member surfaces.
Figure 3B:
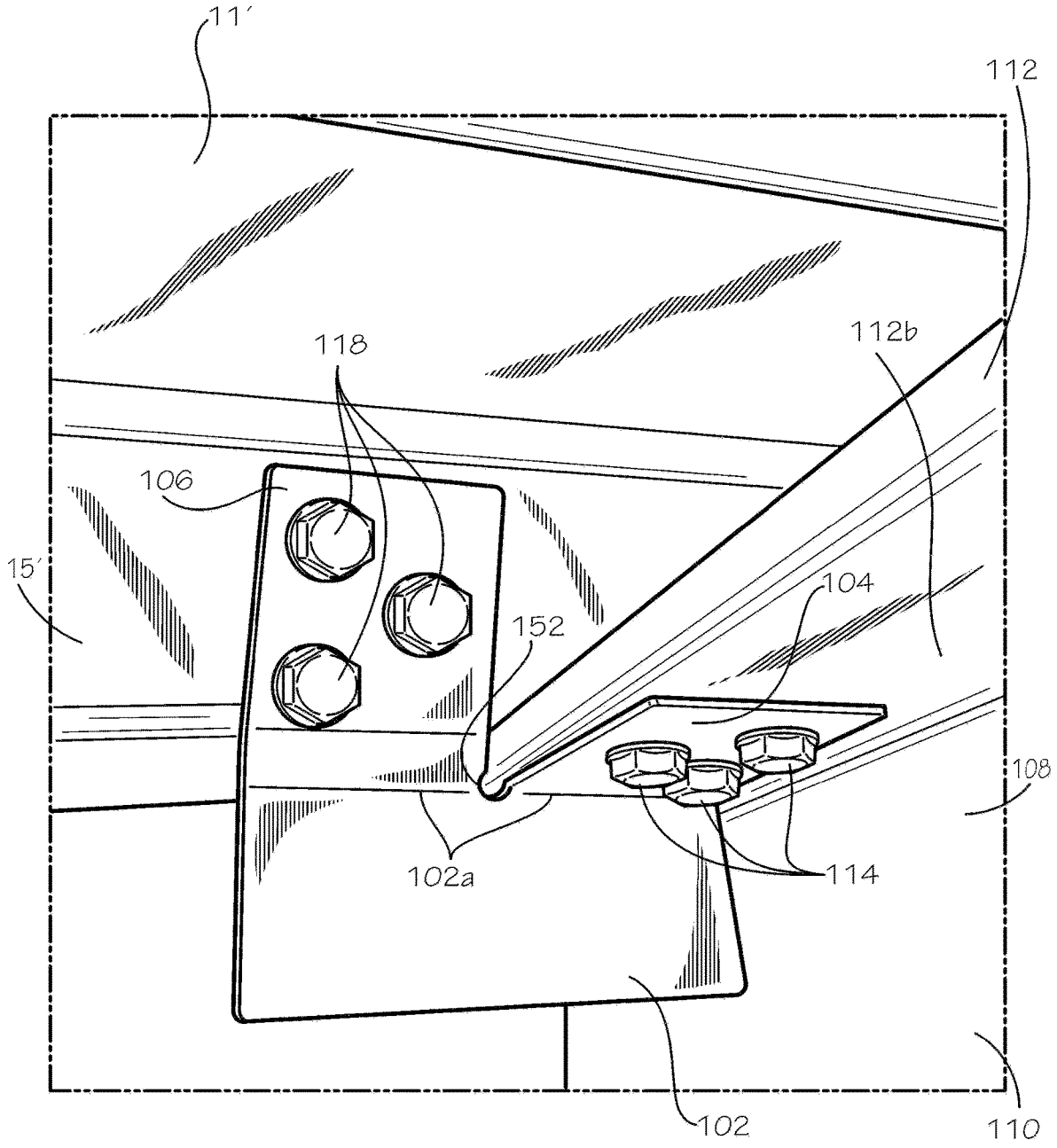
FIG. 3B is a front perspective view illustrating an installed metal deck attachment clip constructed according to an aspect of the present disclosure.

FIGS. 3A and 3B are perspective views illustrating an installed metal deck attachment clip 100 constructed according to an aspect of the present disclosure, with the side perspective view of FIG. 3A illustrating angular relationships among clip and support member surfaces. Clip 100 can be constructed as one-piece member comprising a stiffener 102 with a fold line 102*a* (FIGS. 3B, 4 and 5), a first connector plate 104 extending from the fold line 102*a* at a dihedral angle α to the stiffener 102, and a second connector plate 106 extending from the fold line 102*a* at a dihedral angle β to the stiffener 102. The term "stiffener," as used herein, means a component that is primarily responsible for transmitting flexure and shear loads from one or more connector plates connected to a web 15 of the corrugated metal deck 10 to another clip connector plate connected to a framing support member.

In the example of FIG. 3A, dihedral angle α is preferably 90° when the metal deck attachment clip 100 is manufactured, but dihedral angle α can range from 90° to and including 135°, with a tolerance of ±3°. The maximum angle value 135° for dihedral angle α represents the magnitude of a resulting when a lateral edge of the stiffener 102 aligns with axis 107, which passes through a lateral edge of the second connector plate 106 as shown, and when the value of dihedral angle β is equal to or greater than 180°. Additionally, even if dihedral angle α is 90° when the clip 100 is manufactured, an installer can manually bend the first connector plate 104, either by hand or with a tool such as pliers, to a different dihedral angle α' with respect to the stiffener 102 ranging from and including 91° to and including 135°. The first connector plate 104 is configured for attachment to a support member 108 extending beneath the corrugated metal deck 10, wherein the support member 108 can be a chord angle having a web 110 and a flange 112 with an upper surface 112*a* and an underside 112*b*, in other words, configured like the upper chord 16 of FIG. 1B. The first connector plate 104 can be specifically configured for attachment to the underside 112*b* of the support member flange 112. The flange 112 can have a thickness $T_F$ ranging from less than 0.109" (inches) to greater than ½. Three flange fasteners 114 extend through three respective apertures 116 (FIGS. 4 and 6) defined in the first connector plate 104 and through the flange 112 of the support member 108.

Figure 7:
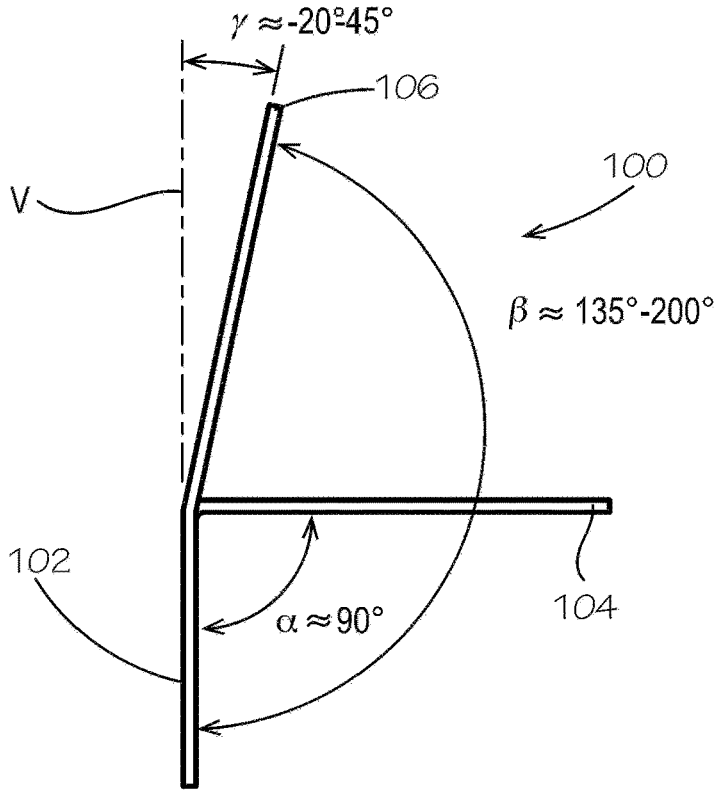
FIG. 7 is a side view of the metal deck attachment clip of FIG. 4, illustrating angular relationships among clip surfaces.

The second connector plate 106 is configured for attachment to an underside of the corrugated metal deck 10, here, the underside 15' of the web portion 15. Underside 11' of crest portion 11 is also shown for context. Dihedral angle β can range from and including 135° to and including 200°, with a tolerance of ±3°, the magnitude of the dihedral angle β within that range varying to conform to various deck web angles, i.e., the angle γ (FIG. 7) that the web 15 makes with a vertical axis V, i.e., an axis normal to the plane containing the trough portions 13 of the corrugated metal deck 10. Even for the same types of corrugated metal decks 10, deck web angles γ can vary by manufacturer. Upon manufacture of the metal deck attachment clip 100, dihedral angle β can have a default magnitude within the range of 135° to 200°, such as 168° to anticipate a deck web angle γ of 12° (defining a positive angle magnitude as a clockwise position with respect to vertical axis V). An installer can then manually bend the second connector plate 106 to a conforming dihedral angle β within the range of 135° to 200° if the magnitude of the deck web angle γ of the deck 10 to be installed varies from the 12° value. As shown in FIG. 7, deck web angle γ can vary within a range of −20° to 45° such that, for example, when y=0°, β≥180° upon clip installation (⊖=180° if y=0° and α=90°). As another example, when y=45°, β≥135° upon clip installation (β=135° if y=45° and α=90°).

Figure 8:
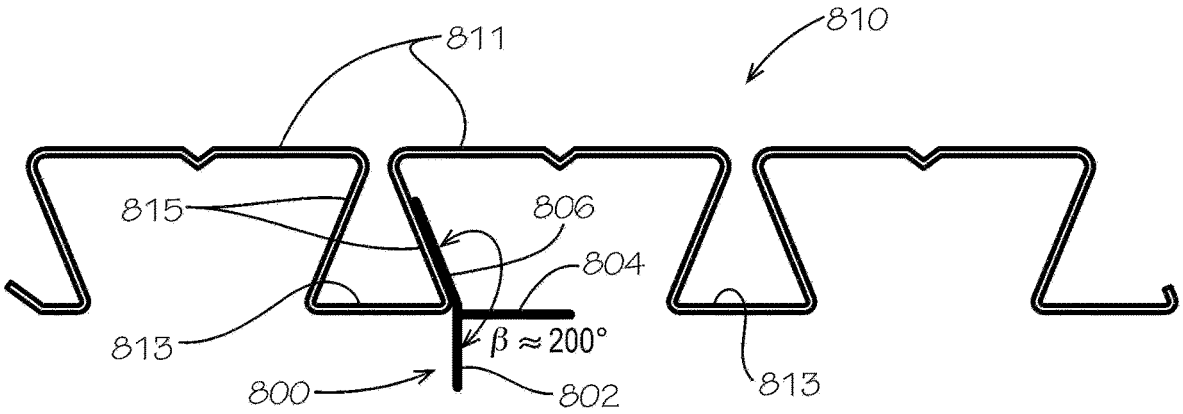
FIG. 8 is a schematic view of the metal deck attachment clip of FIG. 4, with a connector plate bent at an angle of about 200° with respect to the stiffener, to conform to a web configuration of a "dovetail" corrugated metal deck.

As implied from the fact that β can be greater than 180° (up to 200° in the stated range), deck web angle γ can be less than 0°. For example, FIG. 8 shows a "dovetail" corrugated metal deck 810, including crest portions 811, trough portions 813, and web portions 815 connected to respective crest portions 811 and trough portions 813. Each web portion 815 extends at a deck web angle of −20° with respect to a vertical axis (like axis "V" in FIG. 7), such that the dihedral angle β of the conforming metal deck attachment clip 800, which is the angle between stiffener 802 and second connector plate 806, is 200°. FIG. 8 also shows a first connector plate 804, which corresponds to the first connector plate 104 of clip 100 (FIGS. 3A-7). The ability to adjust dihedral angle β in the field, as described herein, eliminates the need to separately manufacture different versions of metal deck attachment clips 100, 800 according to differing fixed dihedral angles β.

Figure 4:
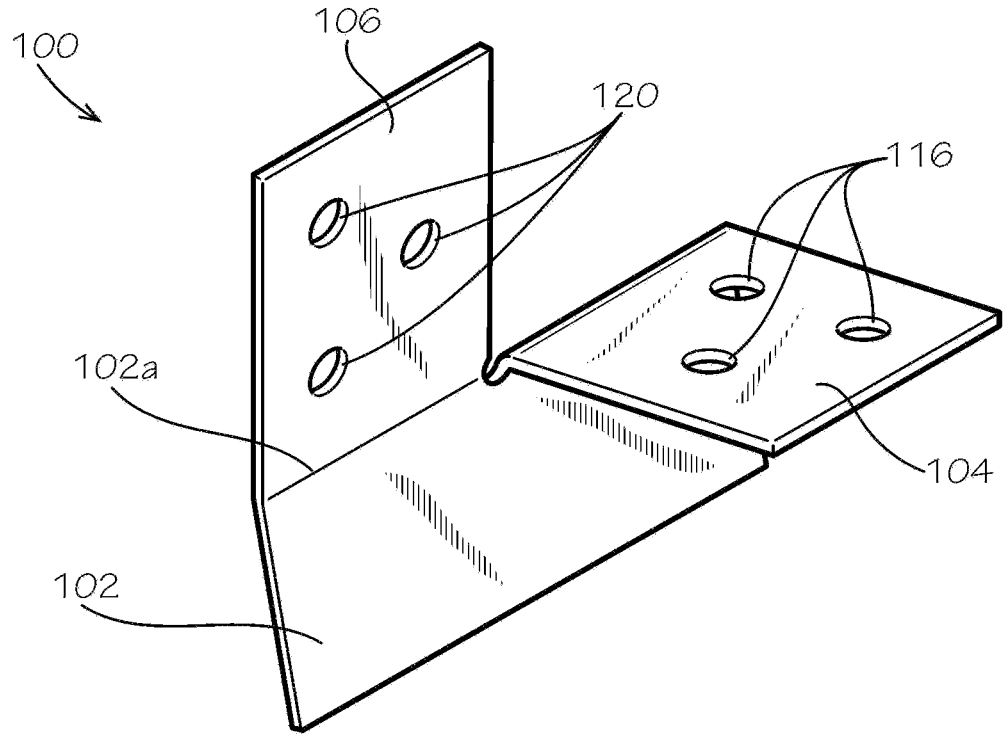
FIG. 4 is a perspective view isolating the metal deck attachment clip illustrated in FIGS. 3A and 3B.
Figure 5:
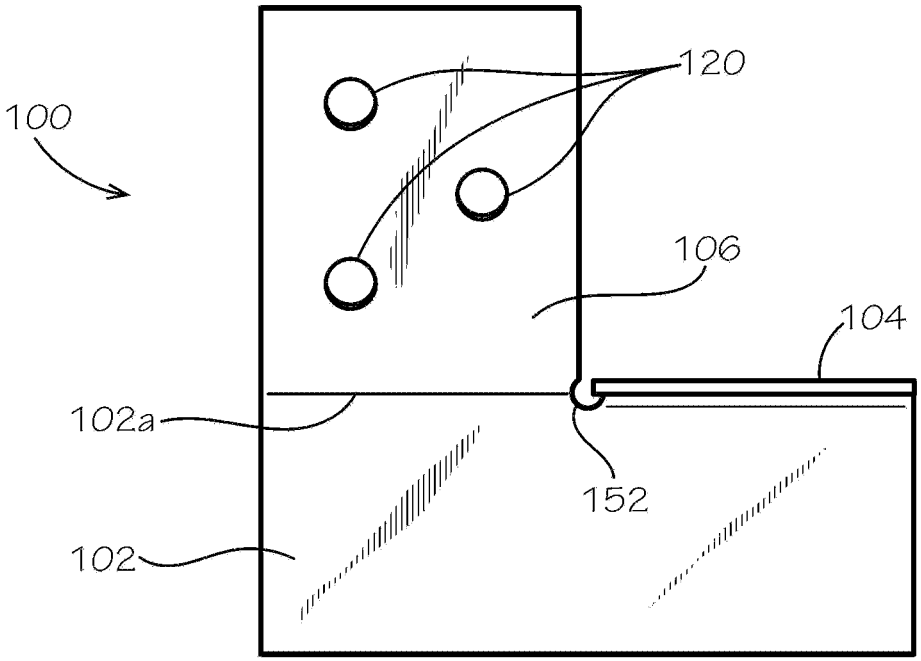
FIG. 5 is a front view of the metal deck attachment clip of FIG. 4.
Figure 6:
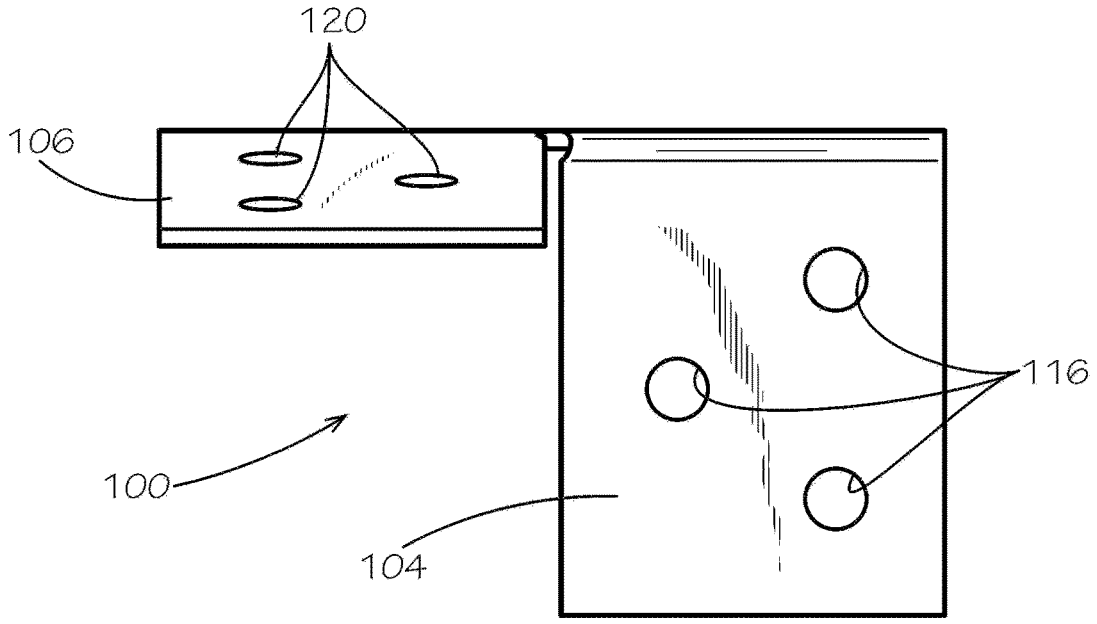
FIG. 6 is a top view of the metal deck attachment clip of FIG. 4.

Referring again to FIGS. 3A and 3B, the second connector plate 106 is shown being attached to the web underside 15' by means of three web fasteners 118 extending through three respective apertures 120 (FIGS. 4-6). The second connector plate 106 can fit on a 1-1/2" deep deck (a dimension common to WR decks and other roof decks), and can be used on deeper decks also. The disclosed configuration of the metal deck attachment clip 100 is particularly advantageous regarding WR decks or shallower decks, because the second connector plate 106 will be flush against the underside 15' of the web portion 15 as soon as the second connector plate 106 extends above the elevation of the upper flange surface 112*a*. This means that despite the shallowness of such web decks, the metal deck attachment clip 100 can still provide a strong attachment to the corrugated metal deck 10 because sufficient area is still provided to accommodate three web fasteners 118. Although FIGS. 3A and 3B show three flange fasteners 114 and three web fasteners 118 (with sets of apertures 116,120 defined in the first connector plate 104 and the second connector plate 106, respectively), the quantity of three is merely exemplary and not intended to be limiting; a greater or lesser number of fasteners could be used depending on design requirements. For example, in other implementations, the second connector plate 106 may have a greater relative length than shown in FIGS. 3A and 3B to fit a 3"-deep corrugated metal deck or even deeper decks, in order to accommodate more flange fasteners 114 into the second connector plate 106 for added strength. Flange fasteners 114 and web fasteners 118 can be self-drilling screws but can also be, for example, bolts, power actuated fasteners, rivets, or other mechanical fasteners. Welds could be used in place of mechanical fasteners. If the fasteners 114,118 are self-drilling screws, the apertures 116,120 in the connector plates 104,106, respectively, can in some implementations be eliminated, and this would also dispense with the need to pre-drill matching holes (not shown) into the flange 112 of the support 108 and into the web portion 15 of the corrugated metal deck 10. In the event of uplift, the first connector plate 104 pushes against the underside 112*b* of support member flange 112, and the flange fasteners 114 prevent the metal deck attachment clip 100 from sliding off the underside 112*b* if the clip 100 begins to bend when loaded.

As best seen in FIG. 3A, when the metal deck attachment clip 100 has been installed, the second connector plate 106 is oriented such that upon attachment of the second connector plate 106 to the underside of the corrugated metal deck 10 (such as to the underside 15' of the web portion 15), each of the web fasteners 118 extend through the second connector plate 106 at an acute angle θ with respect to a longitudinal axis (such as an axis parallel to directional arrows 125 and collinear with upper flange surface 112*a*) of the support member 108. Acute angle θ can range from and including 0° to and including 45°, depending on the deck web angle γ (FIG. 7). This means that the web fasteners 118 are loaded in shear against uplift forces (i.e., forces acting upwardly in a direction perpendicular to the plane of the trough portion 13 of the corrugated metal deck 10) when acute angle θ is 0°, and are loaded at least partially in shear when the acute angle θ ranges from 1° to 45°. For earthquake resistance (meaning the resistance of lateral forces acting in the plane of the trough portion 13 or planes parallel thereto), the flange fasteners 114 are all loaded in shear. When the acute angle θ ranges from 1° to 45°, and the lateral forces move in one or both of the directional arrows 125, the web fasteners 118 are loaded at least partially in shear. All fasteners 114,118 are loaded in shear against lateral forces acting along a "z" axis (normal to the page of FIG. 3A). The metal deck attachment clip 100 can thus be used in retrofits to augment structural strength against both hurricanes and earthquakes, i.e., enhancing resistance against both uplift forces and lateral forces.

FIGS. 4-7 show additional views of the metal deck attachment clip 100 and several of its above-discussed features, as set forth in the drawing descriptions. The metal deck attachment clip 800 (FIG. 8) has likewise already been discussed above.

Figure 9:
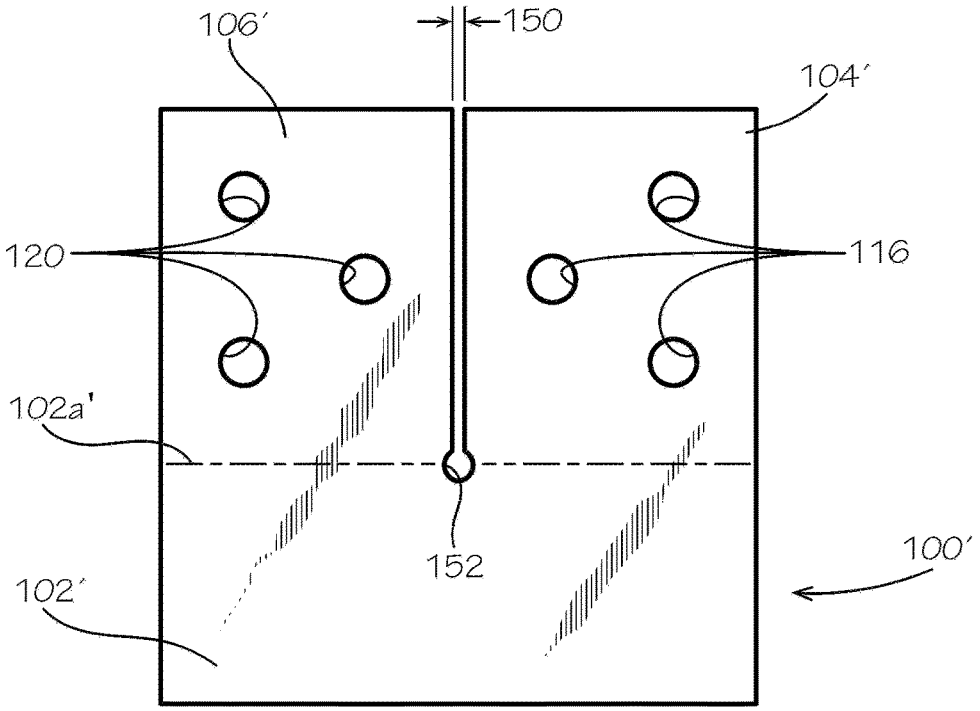
FIG. 9 is a top view of an unbent one-piece member from which the metal deck attachment clip of FIG. 4 is constructed.

FIG. 9 is a top view of an unbent one-piece member 100' from which the metal deck attachment clip 100 is constructed. The one-piece member 100' can easily be formed into the metal deck attachment clip 100 by metal punching, in a manner that would promote economy of materials, though the mention of punching is not meant to be limiting, as the metal deck attachment clip 100 could be formed by methods other than punch forming. The unbent one-piece member 100' includes regions 102',104',106' that respectively become the stiffener 102, the first connector plate 104, and the second connector plate 106, once regions 104' and 106' are bent about a line 102*a*' corresponding to the fold line 102*a* of the stiffener 102. Region 104' defines the apertures 116, and region 106' defines the apertures 120. Regions 104',106' are separated by a gap 150 coplanar to the stiffener region 102', the gap 150 originating at a cutout section 152 formed into the stiffener region 102. Although cutout section 152 is shown as having a circular shape, the particular shape shown in FIG. 9 is not intended to be limiting, so long as it helps avoid stress concentration that would otherwise occur at an inside corner of the first connector plate 104 (i.e., where cutout section 152 is now located) when the resulting metal deck attachment clip 100 has been installed.

Figure 10:
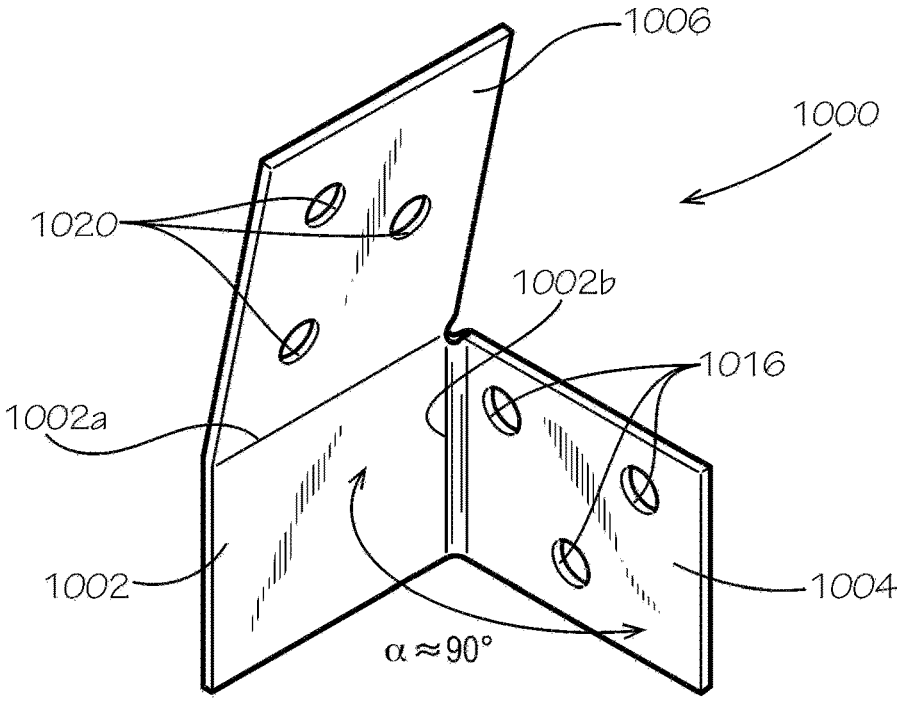
FIG. 10 is a perspective view of a metal deck attachment clip constructed according to another aspect of the present disclosure, illustrating an angular relationship among clip surfaces.
Figure 11:
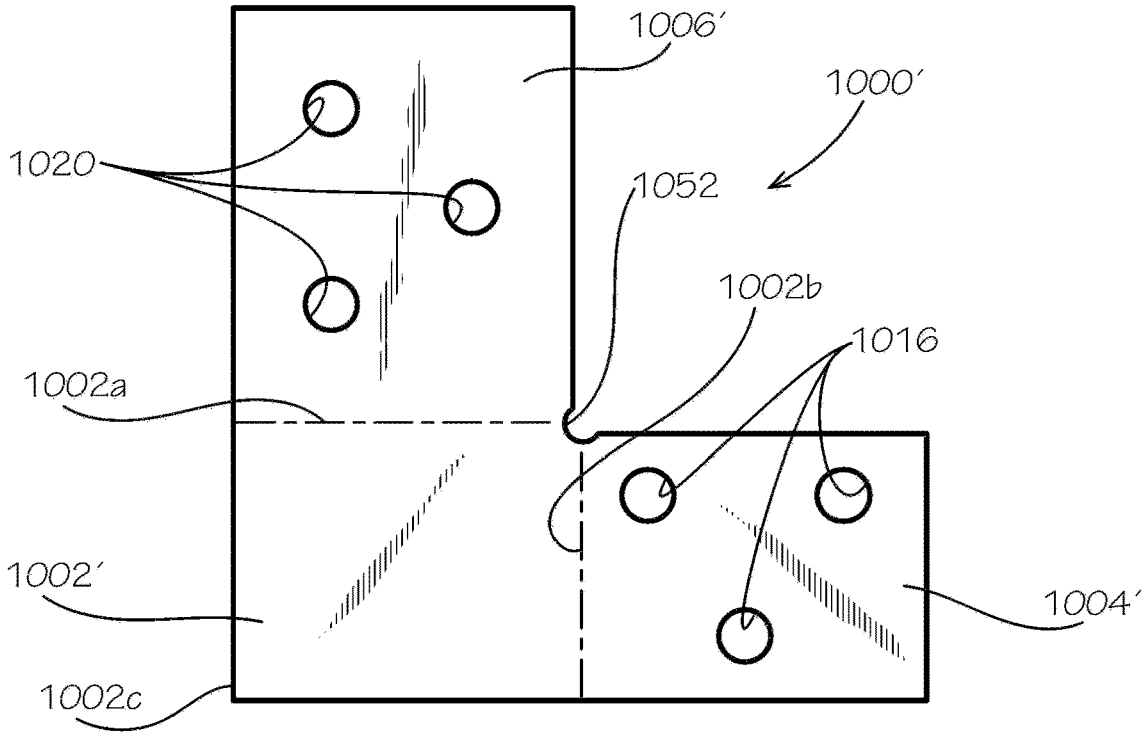
FIG. 11 is a top view of an unbent one-piece member from which the metal deck attachment clip of FIG. 10 is constructed.
Figure 12:
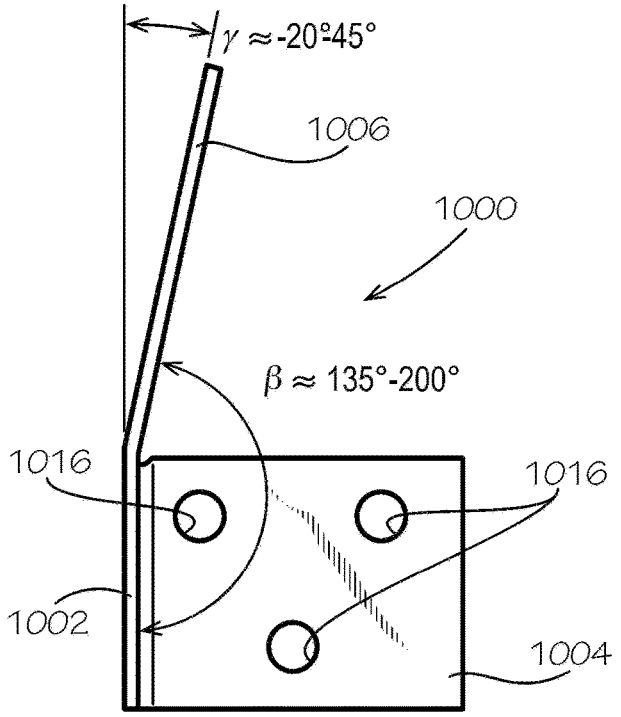
FIG. 12 is a side view of the metal deck attachment clip of FIG. 10, illustrating an angular relationship among clip surfaces.

FIGS. 10 and 12-15 illustrate a metal deck attachment clip 1000 constructed according to another aspect of the present disclosure, with FIGS. 10 and 12 illustrating angular relationships among clip surfaces, and with FIG. 11 illustrating an unbent one-piece member 1000' from which the metal deck attachment clip 1000 is constructed.

Referring to FIGS. 10 and 12, the metal deck attachment clip 1000 can be constructed as one-piece member comprising a stiffener 1002 with a longitudinal fold line 1002*a* and a lateral fold line 1002*b* extending from the longitudinal fold line 1002*a*, a first connector plate 1004 extending from the lateral fold line 1002*b* at a dihedral angle $\alpha$ to the stiffener 1002, and a second connector plate 1006 extending from the longitudinal fold line 1002*a* at a dihedral angle $\beta$ to the stiffener 1002. In the examples of FIGS. 10 and 12, dihedral angle $\alpha$ is 90°, with a tolerance of ±3°, and an installer can bend the first connector plate 1004 with respect to the stiffener 1002 (or vice versa) to attain a 90° magnitude for dihedral angle $\alpha$ if it is not already at that magnitude upon manufacture of the clip 1000. Dihedral angle $\beta$ can vary from 135-200°, with a tolerance of ±3°. As will be discussed in greater detail with regard to FIG. 15, the first connector plate 1004 is configured for attachment to a side of a support member, and the second connector plate 1006 is configured for attachment to an underside of the corrugated metal deck 10. The first connector plate 1004 can define a first set of apertures 1016, and the second connector plate 1006 can define a second set of apertures 1020, but if self-drilling fasteners are used in the installation of the metal deck attachment clip 1000, the sets of apertures 1016,1020 can, in some implementations, be eliminated.

FIG. 11 is a top view of an unbent one-piece member 1000' from which the metal deck attachment clip 1000 is constructed. The one-piece member 1000' can easily be formed into the metal deck attachment clip 1000 by metal punching, in a manner that would promote economy of materials, though the mention of punching is not meant to be limiting, as the metal deck attachment clip 1000 could be formed by methods other than punch forming. The unbent one-piece member 1000' includes regions 1002',1004',1006' that respectively become the stiffener 1002, the first connector plate 1004, and the second connector plate 1006, once regions 1004' and 1006' are respectively bent about the lateral fold line 1002*b* and the longitudinal fold line 1002*a*. Region 1004' defines the apertures 1016, and region 1006' defines the apertures 1020. A cutout section 1052 can be formed into the stiffener region 1002 at a corner thereof. Although cutout section 1052 is shown as having a circular shape, the particular shape shown in FIG. 11 is not intended to be limiting, so long as it helps avoid stress concentration that would otherwise occur at an inside corner of the first connector plate 1004 (i.e., where cutout section 1052 is now located) when the resulting metal deck attachment clip 1000 has been installed. The one-piece member 1000' need not be restricted to the particular configuration shown in FIG. 11; for instance, instead of extending from lateral fold line 1002*b*, region 1004' could extend from the lateral edge 1000*c* of the stiffener region 1002', resulting in a "left-handed" version of the metal deck attachment clip 1000. Such a version would be useful for attaching the clip 1000 to the left-hand side of a web portion 15 of the corrugated metal deck 10 (as one views FIG. 15).

Figure 13:
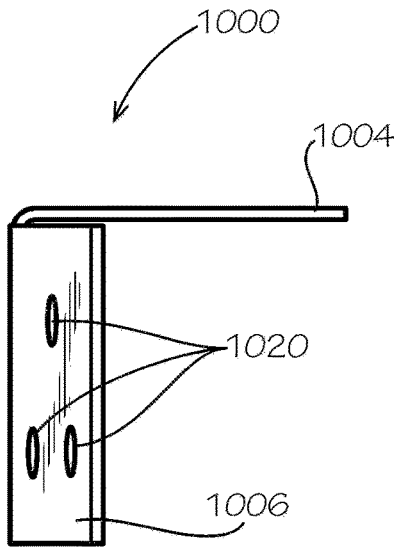
FIG. 13 is a top view of the metal deck attachment clip of FIG. 10.
Figure 14:
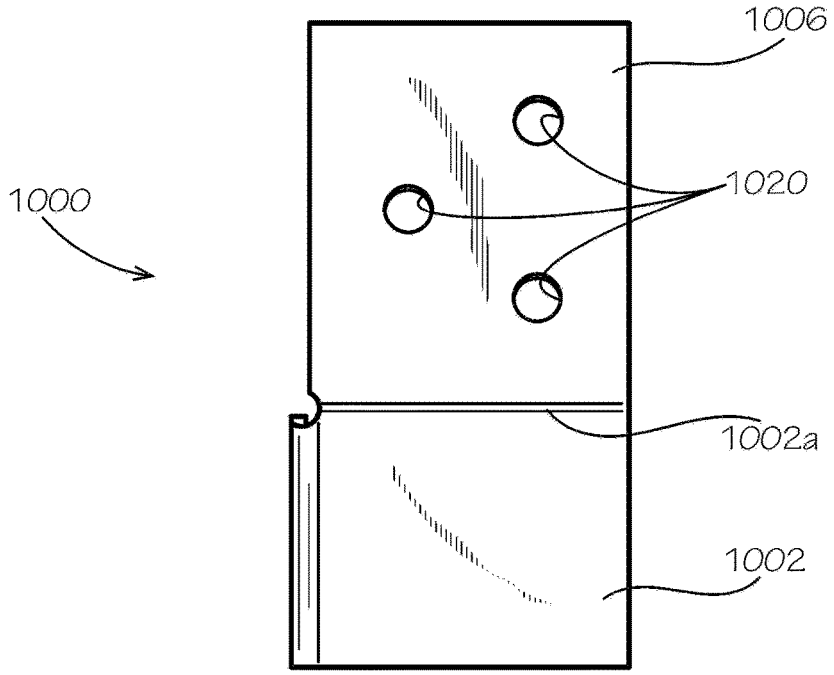
FIG. 14 is a rear view of the metal deck attachment clip of FIG. 10.

FIGS. 13 and 14 show additional views of the metal deck attachment clip 1000 and several of its above-discussed features, as set forth in the drawing descriptions.

Figure 15:
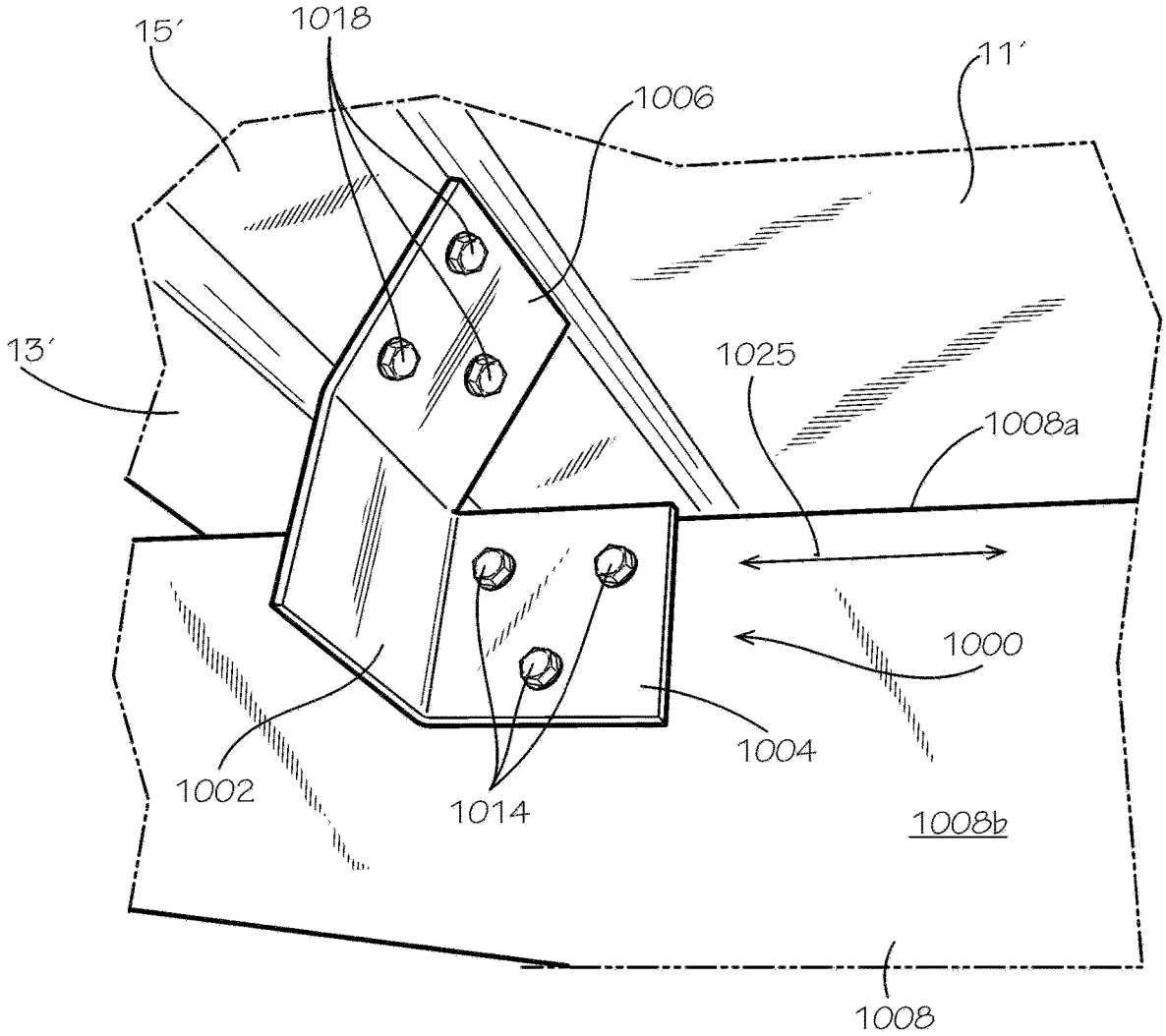
FIG. 15 is a perspective view illustrating the metal deck attachment clip of FIG. 10 installed according to an aspect of the present disclosure.
Figure 16:
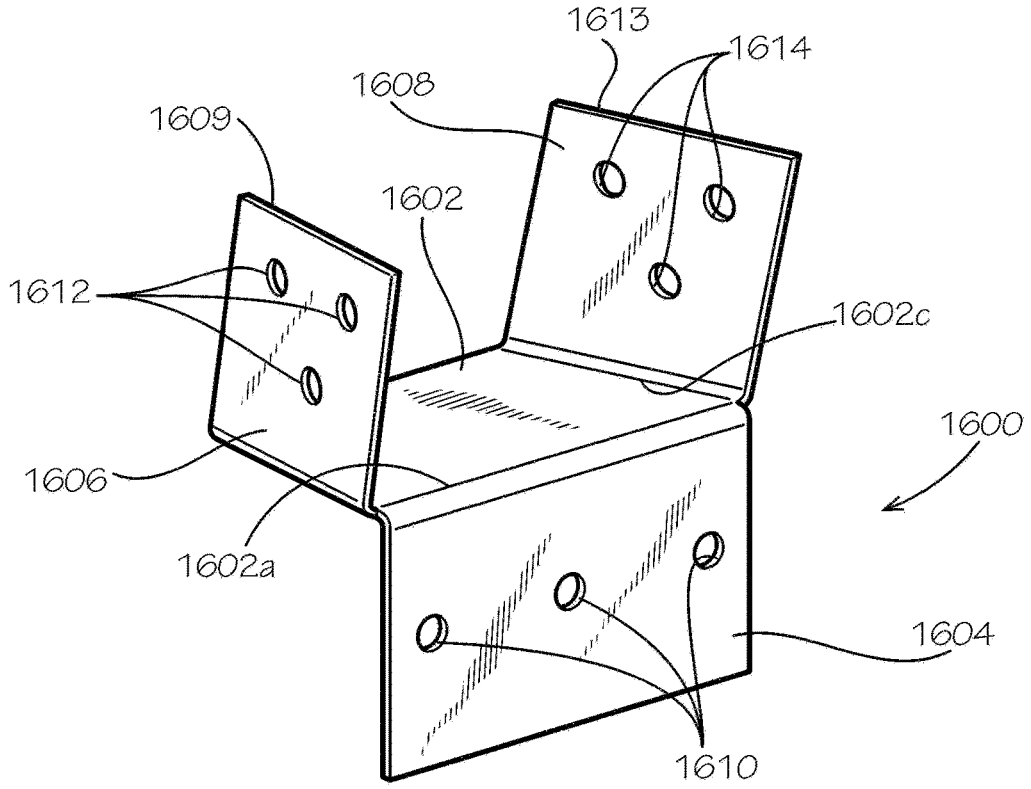
FIG. 16 is a perspective view of a metal deck attachment clip constructed according to another aspect of the present disclosure.

FIG. 15 is a perspective view illustrating the metal deck attachment clip 1000 installed according to an aspect of the present disclosure. Unlike the metal deck attachment clip 100 discussed above with regard to FIGS. 3A and 3B, the metal deck attachment clip 1000 is configured to be installed on a side 1008*b* of a beam (such as wooden beam 1008) having a top surface 1008*a*. Side 1008*b* could alternatively represent, for example, a flat vertical face of a hollow section (tube), though this example is not meant to be limiting. Three beam fasteners 1014 extend through the three respective apertures 1016 (FIG. 10) defined in the first connector plate 1004 and through the side 1008*b* of the beam 1008. Additionally, three web fasteners 1018 attach the second connector plate 1006 to the underside 15' of the web portion 15 of the corrugated metal deck 10. (Underside 11' of crest portion 11, and underside 13' of trough portion 13, are also shown for context.) The three web fasteners 1018 extend through the three respective apertures 1020 (FIG. 10) and into the web portion 15. Although FIG. 15 shows three beam fasteners 1014 and three web fasteners 1018, the quantity of three is merely exemplary and not intended to be limiting; a greater or lesser number of fasteners could be used depending on design requirements. Beam fasteners 1014 and web fasteners 1018 can be self-drilling screws but can also be, for example, bolts, power actuated fasteners, rivets, or other mechanical fasteners. The second connector plate 1006 is oriented such that upon attachment of the second connector plate 1006 to the underside 15' of the metal deck web portion 15, each of the web fasteners 1018 extends through the second connector plate 1006 at an acute angle with respect to a longitudinal axis of the beam 1008 (such as an axis parallel to directional arrows 1025 and collinear with upper beam surface 1008*a*). That acute angle, like the acute angle $\theta$ of FIG. 3A, ranges from 0° to 45° depending on the deck web angle $\gamma$ (FIG. 12). This means that in the installation depicted in FIG. 15, the web fasteners 1018 are loaded in shear against uplift forces when the acute angle is 0°, and are loaded partially in shear when the acute angle ranges from 1° to 45°. Additionally, the beam fasteners 1014 are all loaded in shear against uplift forces. For earthquake resistance, when the acute angle ranges from 1° to 45°, and the lateral forces move in one or both of the directional arrows 1025, the web fasteners 1018 are loaded at least partially in shear. Additionally, the beam fasteners 1014 are all loaded in shear against lateral forces acting along one or both of the directional arrows 1025, and the web fasteners 1018 are loaded in shear against lateral forces acting along a "z" axis (normal to the page of FIG. 15). The metal deck attachment clip 1000 can thus be used in retrofits to augment structural strength against both hurricanes and earthquakes, i.e., enhancing resistance against both uplift forces and lateral forces. Further augmentation against both kinds of forces could be done by installing both "right-handed" and "left-handed" versions of the metal deck attachment clip 1000 (see discussion of FIG. 11 above) on the same side of the beam 1008, but on opposing web portions 15 of the deck 10. Still further augmentation could be accomplished by installing two more such clips 1000 on those opposing web portions 15, but on the opposite side of the beam 1008. Such an arrangement would thus feature four clips 1000 on a single beam 1008 associated with a single trough portion 13 of the corrugated metal deck 10. Although FIGS. 3A and 3B show three flange fasteners 114 and three web fasteners 118 (with sets of apertures 116,120 defined in the first connector plate 104 and the second connector plate 106, respectively), the quantity of three is merely exemplary and not intended to be limiting; a greater or lesser number of fasteners could be used depending on design requirements.

Figure 17:
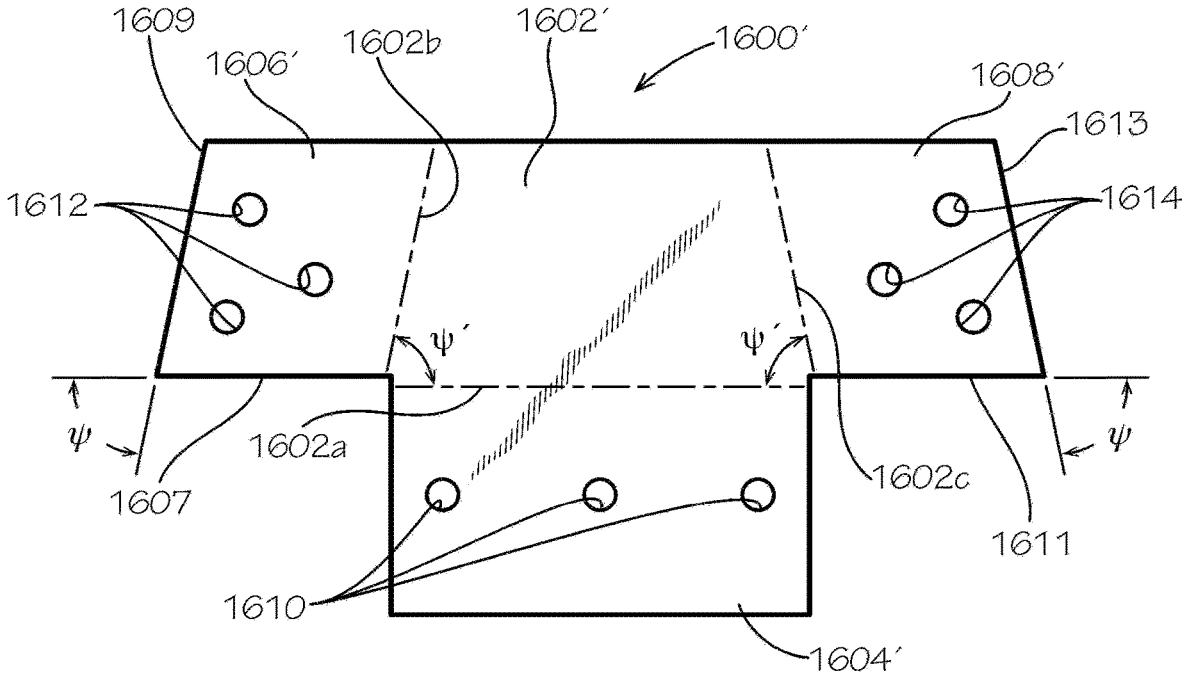
FIG. 17 is a top view of an unbent one-piece member form which the metal deck attachment clip of FIG. 16 is constructed.
Figure 18:
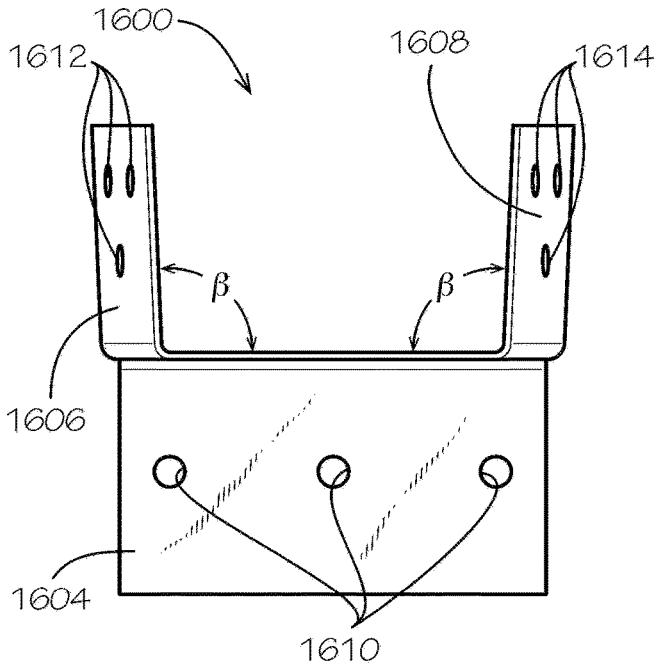
FIG. 18 is a front view of the metal deck attachment clip of FIG. 16, illustrating an angular relationship among clip surfaces.
Figure 19:
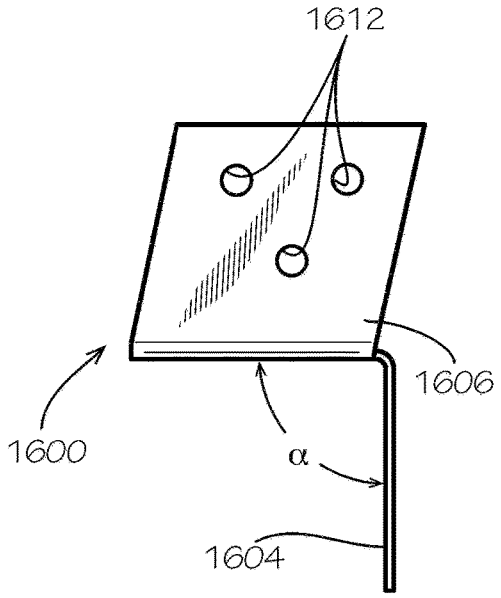
FIG. 19 is a side view of the metal deck attachment clip of FIG. 16, illustrating an angular relationship among clip surfaces.
Figure 20:
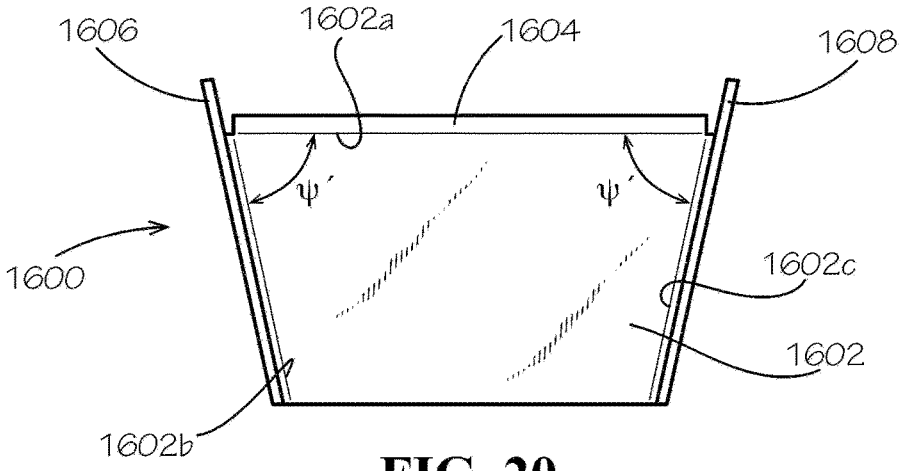
FIG. 20 is a top view of the metal deck attachment clip of FIG. 16.

FIGS. 16 and 18-21 illustrate a metal deck attachment clip 1600 constructed according to another aspect of the present disclosure, with FIGS. 18 and 19 illustrating angular relationships among clip surfaces, and with FIG. 17 illustrating a one-piece member 1600' from which the metal deck attachment clip 1600 is constructed.

Referring to FIGS. 16 and 18-21, the metal deck attachment clip 1600 can be constructed as one-piece member that includes a stiffener 1602 having a longitudinal fold line 1602*a*, a first lateral fold line 1602*b* (FIG. 21) extending from the longitudinal fold line 1602*a*, and a second lateral fold line 1602*c* extending from the longitudinal fold line 1602*a* opposite the first lateral fold line 1602*b*. A first connector plate 1604 extends from the longitudinal fold line 1602*a* of the stiffener 1602 at a dihedral angle $\alpha$ to the stiffener 1602, a second connector plate 1606 extends from the first lateral fold line 1602*b* of the stiffener 1602 at a dihedral angle $\beta$ to the stiffener 1602, and a third connector plate 1608 extends from the second lateral fold line 1602*c* of the stiffener 1602, also at a dihedral angle $\beta$ to the stiffener. Dihedral angles $\alpha$ and $\beta$ can each have a nominal magnitude of 90°±3°, though these magnitudes are not intended to be limiting. Additionally, both $\alpha$ and $\beta$ can be adjusted in the field, but in some implementations, only to two to three degrees each. The second connector plate 1606 has an upper lateral edge 1609, and the third connector plate 1608 has an upper lateral edge 1613. The first connector plate 1604 can define a first set of apertures 1610, the second connector plate 1606 can define a second set of apertures 1612, and the third connector plate 1608 can define a third set of apertures 1614, but if self-drilling fasteners are used in the installation of the metal deck attachment clip 1600, the sets of apertures 1610,1612,1614 can, in some implementations, be eliminated.

FIG. 17 is a top view of an unbent one-piece member 1600' from which the metal deck attachment clip 1600 is constructed. The one-piece member 1600' can easily be formed into the metal deck attachment clip 1600 by metal punching, in a manner that would promote economy of materials, though the mention of punching is not meant to be limiting, as the metal deck attachment clip 1600 could be formed by methods other than punch forming. The unbent one-piece member 1600' includes regions 1602',1604',1606', 1608' that respectively become the stiffener 1602, the first connector plate 1604, and the second connector plate 1606, and the third connector plate 1608, once region 1604' is bent about the longitudinal fold line 1602*a*, region 1606' is bent about the first lateral fold line 1602*b*, and region 1608' is bent about the second lateral fold line 1602*c*. Region 1604' defines the apertures 1610, region 1606' defines the apertures 1612, and region 1608' defines the apertures 1614. As seen in FIG. 17, the lateral edge 1609 of region 1606' can be slanted at an offset angle $\psi$ with respect to a longitudinal edge 1607 of region 1606', and the lateral edge 1613 of region 1608' can be slanted at the same offset angle $\psi$ with respect to a longitudinal edge 1611 of region 1608'. If longitudinal fold line 1602*a* is parallel to the longitudinal edges 1607,1611, and if the lateral edges 1609,1613 are respectively parallel to the lateral fold lines 1602*b*,1602*c*, then the respective angles $\psi'$ between the longitudinal fold line 1602*a* and the first lateral fold line 1602*b*, and between the longitudinal fold line 1602*a* and the second lateral fold line 1602*c* are both equal to the offset angle $\psi$, with angles $\psi'$ also seen in the finished clip of FIG. 20. Angles $\psi$ and $\psi'$ can have a magnitude of 78°±3°, though this magnitude is not intended to be limiting. Absent the foregoing parallel relationships, $\psi$ and $\psi'$ would not be identical, and such identity is not required. The slanting of the lateral edges 1609, 1613, and of the lateral fold lines 1602*b*,1602*c* allows the metal deck attachment clip 1600 to more closely conform to the junctions of the underside surfaces 15*a*',11*b*',15*b*' (FIG. 21) of the corrugated metal deck 10 than if no slant were used.

Figure 21:
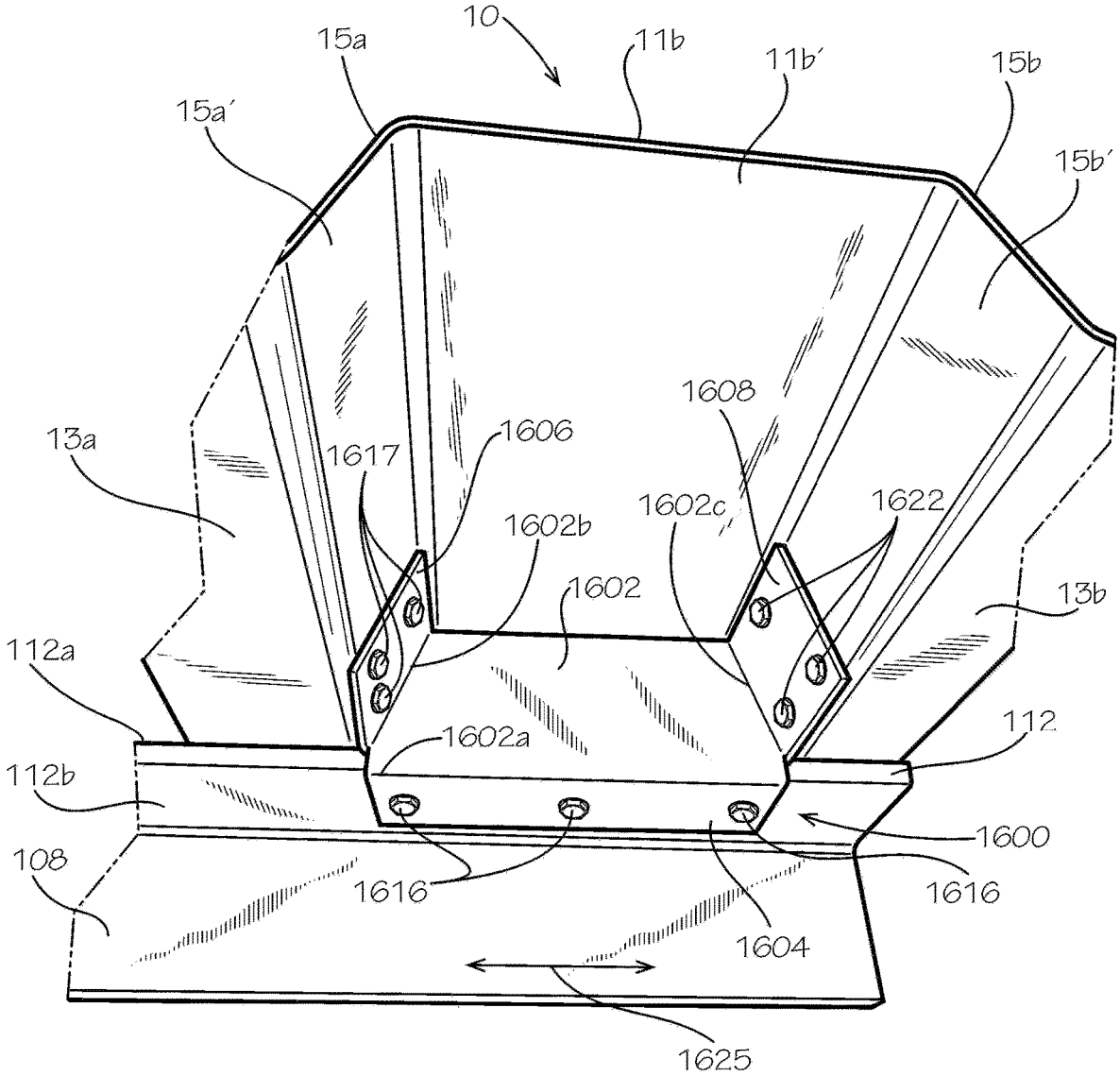
FIG. 21 is a perspective view illustrating the metal deck attachment clip of FIG. 16 installed according to an aspect of the present disclosure.

As best seen in FIG. 21, the first connector plate 1604 is configured for attachment to an underside 112*b* of a flange 112 of a support member 108, via a set of beam fasteners 1616 extending through the first set of apertures 1610 (FIG. 16); the second connector plate 1606 is configured for attachment, via a first set of web fasteners 1617 extending through the second set of apertures 1612 (FIG. 16), to an underside 15*a*' of a first web 15*a* connecting a crest portion 11*b* (crest portion 11*a* shown in FIG. 24) of the corrugated metal deck 10 to a first trough 13*a* of the corrugated metal deck 10; and the third connector plate 1608 is configured for attachment, via a second set of web fasteners 1622 extending through the third set of apertures 1614 (FIG. 16) to an underside 15*b*' of a second web 15*b* connecting the crest portion 11*b* of the corrugated metal deck 10 to a second trough 13*b* of the corrugated metal deck 10. Although FIG. 21 shows three fasteners in each of the three sets 1616,1617, 1622, the quantity of three fasteners is merely exemplary and not intended to be limiting; a greater or lesser number of fasteners could be used in each set, depending on design requirements. The web fasteners 1617,1622 respectively extend through the second connector plate 1606 and the third connector plate 1608 at acute angles with respect to a longitudinal axis of support member 108 (such as an axis parallel to directional arrows 1625 and collinear with upper flange surface 112*a*). Each such acute angle, like the acute angle $\theta$ in FIG. 3A, ranges from and including 0° to and including 45°, depending on the deck web angle $\gamma$ (FIG. 7) of the corrugated metal deck 10. Thus, the web fasteners 1617,1622 are loaded in shear against uplift forces when their respective acute angles are 0°, and are loaded partially in shear when the acute angles range from 1° to 45°. The beam fasteners 1616 may be loaded in tension against uplift forces, but they still provide resistance to uplift forces because upon application of uplift force to the clip 1600, the heads of the beam fasteners 1616 would distribute that force to the first connector plate 1604, which abuts against the underside 112*b* of flange 112, and which thus further distributes that uplift force to the flange 112. For earthquake resistance, when the acute angles range from 1° to 45°, and the lateral forces move in one or both of the directional arrows 1025, the web fasteners 1617,1622 are loaded at least partially in shear. Additionally, the beam fasteners 1616 are all loaded in shear against lateral forces acting along one or both of the directional arrows 1625, and the web fasteners 1617,1622 are loaded in shear against lateral forces acting along a "z" axis (normal to the page of FIG. 21). The metal deck attachment clip 1600 can thus be used in retrofits to augment structural strength against both hurricanes and earthquakes, i.e., enhancing resistance against both uplift forces and lateral forces.

Figure 22:
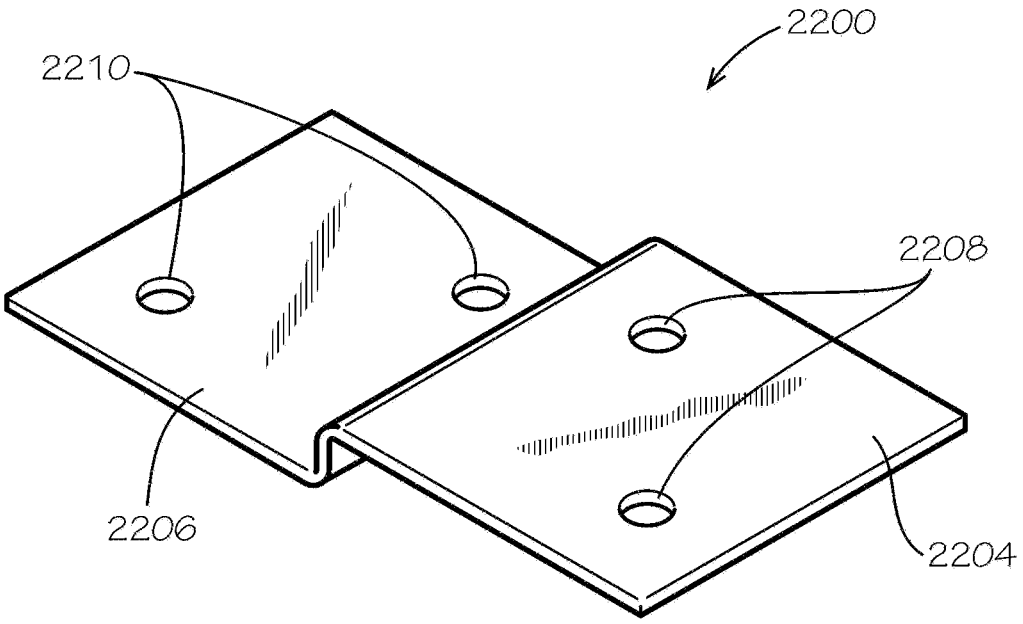
FIG. 22 is a perspective view of a metal deck attachment clip constructed according to yet another aspect of the present disclosure.
Figure 23:
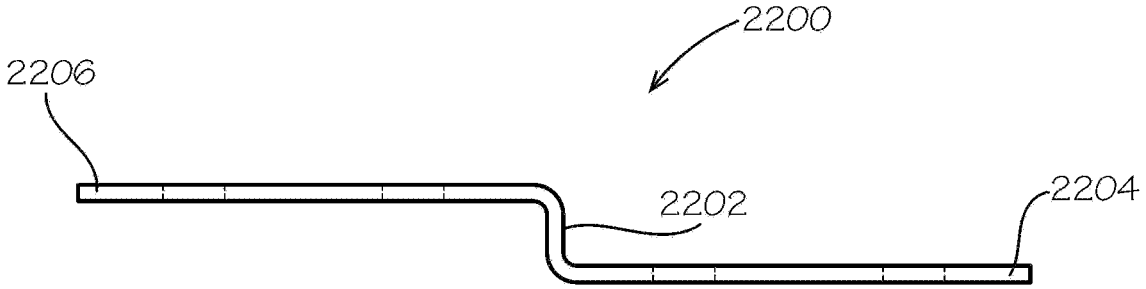
FIG. 23 is a side view of the metal deck attachment clip of FIG. 22.
Figure 24:
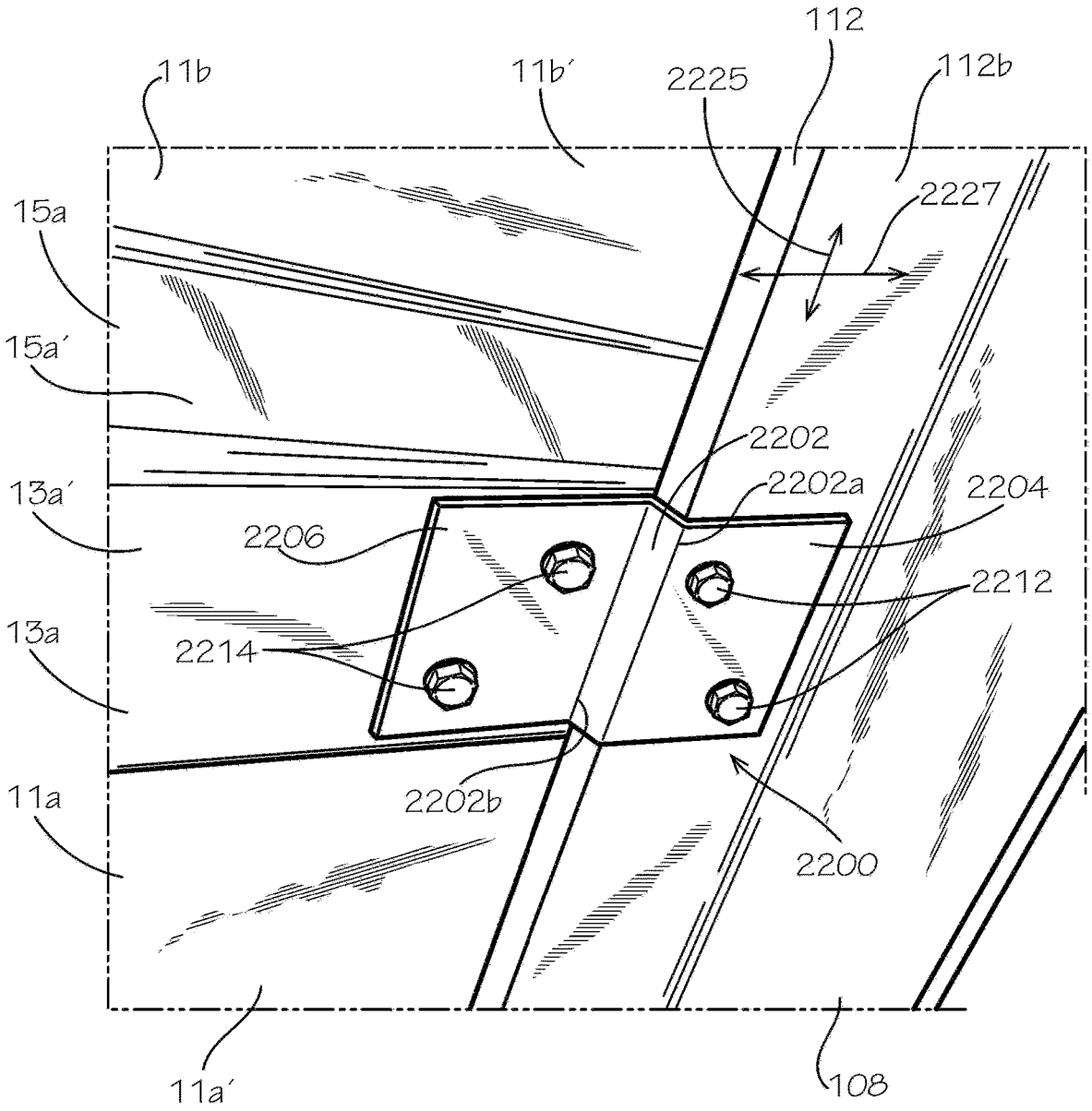
FIG. 24 is a perspective view illustrating the metal deck attachment clip of FIG. 22 installed according to an aspect of the present disclosure.

FIGS. 22-24 illustrate a metal deck attachment clip 2200 constructed according to yet another aspect of the present disclosure. Metal deck attachment clip 2200 can be a one-piece member that includes a central section 2202, the central section having a first longitudinal fold line 2202*a* and a second longitudinal fold line 2202*b* opposite the first longitudinal fold line 2202*a*. Central section 2202 can be formed simply by bending a flat one-piece member at the longitudinal fold lines 2202*a,b* of the central section 2202 to result in the shape best seen in FIG. 23. A first connector plate 2204 extends from the first longitudinal fold line 2202*a*, and a second connector plate 2206 extends from the second longitudinal fold line 2202*b*. As best seen in FIG. 23, the profile of central section 2202 is substantially perpendicular to the profile of the first connector plate 2204 and to the profile of the second connector plate 2206. First connector plate 2204 defines a first pair of apertures 2208, and second connector plate 2206 defines a second pair of apertures 2210, but if self-drilling fasteners are used in the installation of the metal deck attachment clip 2200, the sets of apertures 2208,2210 can, in some implementations, be eliminated.

FIG. 24 is a perspective view illustrating the metal deck attachment clip 2200 installed according to an aspect of the present disclosure. For ease of reference, FIG. 24 shares some reference numerals with FIG. 21, such that visualization of the underside of the same corrugated metal deck 10 is promoted with both figures. As best seen in FIG. 24, the first connector plate 2204 of the metal deck attachment clip 2200 is configured for attachment to the underside 112*b* of the flange 112 of the support member 108, via a set of beam fasteners 2212 extending through the first set of apertures 2208 (FIG. 22) and into the support member flange 112. The second connector plate 2206 is configured for attachment, via a set of trough fasteners 2214 extending through the second set of apertures 2210 (FIG. 22), to an underside 13*a*' of the trough 13*a* (introduced in FIG. 21) of the corrugated metal deck 10. Although FIG. 24 shows two fasteners in each of the sets 2212,2214, the quantity of two fasteners is merely exemplary and not intended to be limiting; a greater or lesser number of fasteners could be used in each set, depending on design requirements. The fasteners 2212,2214 are shown loaded in tension against uplift forces, but they still provide resistance to uplift forces because upon application of uplift force to the clip 2200, the heads of the beam fasteners 2212 would distribute that force to the first connector plate 2204, which abuts against the underside 112*b* of flange 112, and which thus further distributes that uplift force to the flange 112. Similarly, the heads of the trough fasteners 2214 would distribute the uplift force to the second connector plate 2206, which abuts against the underside 13*a*' of trough 13*a*, and which, through the central section 2202, transmits some of that force to the first connector plate 2204, thus further distributing that uplift force to the support member 108. Additionally, for earthquake resistance, both sets of fasteners 2212,2214 are loaded in shear against lateral forces acting in the direction of arrows 2225 and 2227. Therefore, even though the trough fasteners 2214 are attached to the trough 13*a* of the corrugated metal deck 10 instead of to the web 15*a* of that deck, the metal deck attachment clip 2200 still provides enhanced resistance to both uplift and seismic (lateral) forces when compared to conventional retrofit hardware.

The present disclosure contemplates several modifications concerning the type of connection that can be made between each connector plate and its respective structural member (such as between the second connector plate and the metal deck). For example, instead of using screws or rivets to accomplish such connections, power actuated fasteners can be added to the connectors. For further example, each connector plate could be attached to its respective structural member by welding (such as resistance welding and arc welding). Still further, instead of welding, an adhesive could be used to join each connector plate to its respective structural member surface. If either welding or an adhesive is used in place of fasteners, there would not be any need for fastener holes in either connector plate.

The present disclosure also contemplates that the disclosed clip, while primarily intended for retrofit applications, could be used in original construction to achieve the structural strengthening benefits discussed herein.

Although several aspects have been disclosed in the foregoing specification, it is understood by those skilled in the art that many modifications and other aspects will come to mind to which this disclosure pertains, having the benefit of the teaching presented in the foregoing description and associated drawings. It is thus understood that the disclosure is not limited to the specific aspects disclosed hereinabove, and that many modifications and other aspects are intended to be included within the scope of any claims that can recite the disclosed subject matter.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, can be executed out of order from that shown or discussed, including substantially concurrently or in reverse order, depending on the functionality involved, as would be understood by those reasonably skilled in the art of the present disclosure. Many variations and modifications can be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A method of retrofitting a structure having a corrugated metal deck to augment its resistance to uplift and seismic forces, comprising the steps of:

attaching a first connector plate of a one-piece clip to a support member extending beneath the corrugated metal deck by attaching the one-piece clip to an underside of a flange of the support member; and attaching a second connector plate of the one-piece clip to an underside of the corrugated metal deck by attaching the second connector plate to a bottom side of a web that connects a crest portion of the corrugated metal deck to a trough of the corrugated metal deck.

2. The method of claim 1, wherein the second connector plate of the one-piece clip extends from a longitudinal fold line of a stiffener at a dihedral angle to the stiffener, and further comprising the step of adjusting the dihedral angle at an installation site prior to attaching the second connector plate to the underside of the corrugated metal deck, so as to conform the dihedral angle to a deck web angle of the web of the corrugated metal deck.

3. The method of claim 1, wherein the step of attaching a first connector plate of a one-piece clip to a support member extending beneath a corrugated metal deck includes the step of driving at least one fastener through the first connector plate and through the support member, such that the at least one fastener is installed in an upside down orientation, with a head of the at least one fastener pointing downwardly.

* * * * *